US005738348A

United States Patent [19]

Yasue et al.

[11] Patent Number: 5,738,348

[45] Date of Patent: Apr. 14, 1998

[54] SHEET FEEDER

[75] Inventors: Takuya Yasue; Koichiro Yokoyama; Masaki Shimomura; Toshikazu Kotaka; Kazutoshi Kashiwabara; Takeo Kishida, all of Nagano, Japan

[73] Assignee: Seiko Epson Corporation, Tokyo, Japan

[21] Appl. No.: 578,817

[22] Filed: Dec. 26, 1995

[30] Foreign Application Priority Data

Dec. 26, 1994 [JP] Japan ..... 6-337299

[51] Int. Cl.[6] ..... B65H 3/06

[52] U.S. Cl. ..... 271/118; 271/119; 271/126; 271/171

[58] Field of Search ..... 271/118, 119, 271/126, 127, 160, 171

[56] References Cited

U.S. PATENT DOCUMENTS

| | | | |
|---|---|---|---|
| 4,505,571 | 3/1985 | Kimura et al. | 355/3 |
| 4,623,137 | 11/1986 | Irie et al. | 271/127 |
| 4,697,803 | 10/1987 | Kan et al. | 271/171 |
| 4,763,891 | 8/1988 | Kodama | 271/127 |
| 4,786,042 | 11/1988 | Stemmle | 271/171 |
| 5,009,410 | 4/1991 | Fujii et al. | 271/127 |
| 5,253,854 | 10/1993 | Tanoue et al. | 271/118 |
| 5,255,903 | 10/1993 | Parsons et al. | 271/119 |

FOREIGN PATENT DOCUMENTS

| | | | |
|---|---|---|---|
| 60-61436 | 9/1983 | Japan | B65H 3/06 |
| 59-64430 | 12/1984 | Japan . | |
| 0123729 | 5/1988 | Japan | 271/119 |
| 404159929 | 6/1992 | Japan | 271/119 |
| 405186060 | 7/1993 | Japan | 271/171 |
| 2102390 | 2/1983 | United Kingdom | B65H 43/00 |
| 2255330 | 11/1992 | United Kingdom | B65H 1/108 |

OTHER PUBLICATIONS

British Search Report dated 31 Jan. 1996.

IBM Technical Disclosure Bulletin, Pre–Buckle Forming Back–up Plate for Supply Cassette, Aug. 1980, R.W. Gunell.

*Primary Examiner*—H. Grant Skaggs

*Attorney, Agent, or Firm*—Stroock & Stroock & Lavan LLP

[57] ABSTRACT

A sheet feeder assembly including and a sheet feed roller for feeding a sheet of paper in a sheet feeding direction. A sheet support is spaced apart from the sheet feed roller for supporting the sheet of paper thereon. A retaining plate is mounted on the sheet support. A hopper is displaceable between a first position spaced apart from the sheet feed roller so that the paper supported on the hopper cannot contact the sheet feed roller and at least a second position where the leading edge of the sheet of paper can contact the sheet feed roller so that the paper is urged towards the sheet feed roller.

22 Claims, 9 Drawing Sheets

290

112
110
114
5
4
401
400
4
290
5
113
113a

SHEET FEEDER

BACKGROUND OF THE INVENTION

The present invention relates generally to sheet feeders for feeding sheets of paper into a printer, and, in particular, to a sheet feeder assembly for automatically feeding individual sheets of paper in a printer.

Reference is made to FIG. 14 which depicts a conventional sheet feeder assembly generally indicated as 10, constructed in accordance with the prior art. Sheet feed assembly 10 is depicted as being mounted in a printer main body 5 which includes therein a sheet feed roller shaft 8 having a sheet feed roller 3 rotatably mounted thereon and a separation pad 4 for assisting in the separation of the individual sheets, of paper as they are fed into the main body 5 from a sheet feed tray. Sheet feeder assembly 10 includes a sheet feed tray 1 constructed to accommodate a plurality of individual sheets of paper having an integrally formed front wall 7 for supporting the front edges of the paper when the tray is turned upwardly in a vertical direction as depicted in FIG. 14.

A hopper 2 is provided in tray 1 and may be pivotable about a pivot point 9 for urging the individual sheets of paper towards sheet feed roller 3, and a spring 6 is provided and biased between hopper 2 and tray 1 for biasing hopper 2 away from tray 1 and towards roller 3 so that the individual sheets of paper can be urged towards sheet feed roller 3 and fed into main body 5 while ensuring separation from one another by the operation of separation pad 4.

The sheets of paper are fed from sheet feed tray 1 into the printer in the following manner. As depicted in FIG. 14, sheet feed tray 1 is inclined and essentially vertical. Therefore, the paper stacked within tray 1 is always being urged downwardly and toward sheet roller 3 by the weight of the individual sheets of paper and the biasing action of spring 6. As each sheet is urged towards sheet roller 3 by the weight thereof and the biasing action of spring 6 against hopper 2, sheet feed roller 3 is rotating clockwise in a direction as indicated by the arrow a. A sheet of paper contacting sheet feed roller 3 is separated from the other individual sheets of paper by separation pad 4 in a manner known in the art of conventional sheet feeding assemblies. In this way, it is possible to individually feed sheets of paper into a printer using a relatively simple sheet feeder assembly construction.

However, the use of a vertical inclined tray 1 results in an undesirably large, cumbersome and overall tall printer when the inclined tray is vertically mounted therein. This is undesirable since a large space is required to support the printer when in use.

One attempt at reducing the large space required of this conventional sheet feed assembly and printer is to arrange sheet feed tray 1 horizontally. However, when sheet feed tray 1 is arranged horizontally, the sheets of paper are also arranged horizontally. In this configuration, there is no gravitational force acting upon the sheets of paper to urge them towards sheet feed roller 3 such as the weight of the sheets of paper. Therefore, it is difficult to feed the sheets of paper when tray 1 is mounted horizontally and the reliability of a sheet feeding operation when the tray is mounted horizontally is greatly reduced.

Accordingly, a sheet feeder assembly that can be mounted horizontally in a printer, can reliably feed sheets of paper from a paper to the printer and can be supported in a smaller space than required by prior art printers and sheet feeder assemblies is desired.

SUMMARY OF THE INVENTION

Generally speaking, in accordance with the present invention, an improved sheet feeder assembly is provided. The sheet feeder assembly may include a sheet feed roller rotatably mounted on a roller shaft, a sheet support spaced apart from the sheet feed roller for supporting at least one sheet of paper thereon, a retaining plate mounted on the sheet support for preventing the sheet of paper from moving in a direction opposite to said sheet feeding direction, and at least one hopper displaceable between a first position spaced apart from the sheet feed roller so that the sheet of paper supported on the hopper cannot contact the sheet feed roller and at least a second position where the sheet of paper can contact said sheet feed roller.

The relative positions of the hopper form a first height differential, or gap G1, between the sheet support surface and the hopper surface when the hopper is positioned at the first position and a second height differential, or gap G2, when the hopper is at the second position. In the preferred embodiment, the first gap G1 is larger than the second gap G2. In addition, gap G2 may be set so as to essentially align the plane defined by the sheet support surface and the plane defined by the hopper surface so that the second gap G2 is essentially zero when the hopper is in the second position.

In addition, the present invention is directed to a printer, which may be an ink jet printer by way of example, which utilizes the aforementioned sheet feeding assembly. Lastly, a method of feeding a sheet of paper into a printer is provided. The method includes the steps of providing a sheet feeder assembly that includes a hopper movable to a second position from a first position so as to impart a bend to a sheet of paper, preventing the sheet of paper from moving in a direction opposite to a sheet feeding direction, rotating the sheet feed roller and causing the sheet of paper to be urged towards the sheet feed roller and contacted thereby to cause the paper to be fed into a printer case in the sheet feeding direction. This method may be utilized with the sheet support being positioned substantially parallel to a surface on which the printer case is being supported.

Accordingly, it is an object of the present invention to provide an improved sheet feeder assembly.

Another object of the present invention is to provide a sheet feeder assembly that can accurately and reliably feed individual sheets of paper when the paper is supported horizontally.

Still another object of the present invention is to provide a sheet feeder assembly that reliably, accurately and automatically feeds individual sheets of paper into a printer.

Yet another object of the present invention is to provide a printer and sheet feeder assembly that requires a minimal amount of shelf space or the like:, to be fully operational.

Yet another object of the present invention is to provide a printer that can use an improved sheet feeder assembly that can support sheets in a horizontal direction.

Yet another object of the present invention is to provide a method of feeding paper from a sheet feeder assembly to a printer while the paper is being supported horizontally on a horizontally mounted sheet feeder.

Still other objects and advantages of the invention will in part be obvious and will in part be apparent from the specification.

The invention accordingly comprises the several steps and the relation of one or more of such steps with respect to each of the others, and the apparatus, embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is made to the following description taken in connection with the accompanying drawings in which.

DETAILED DESCRIPTION OF THE PREFERRED EMBODIMENT

Figure 1:
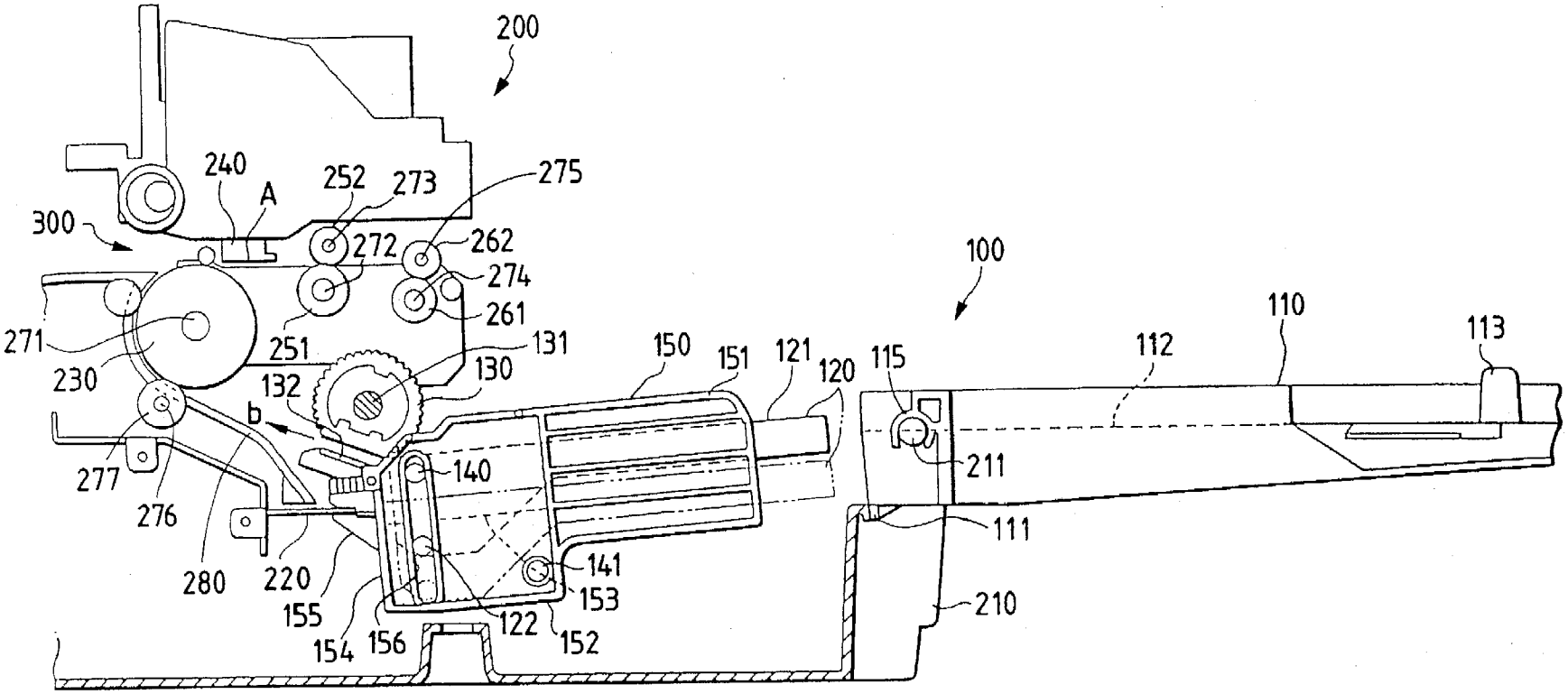
FIG. 1 is a sectional view of a printer and sheet feeder assembly constructed in accordance with the present invention.
Figure 2:
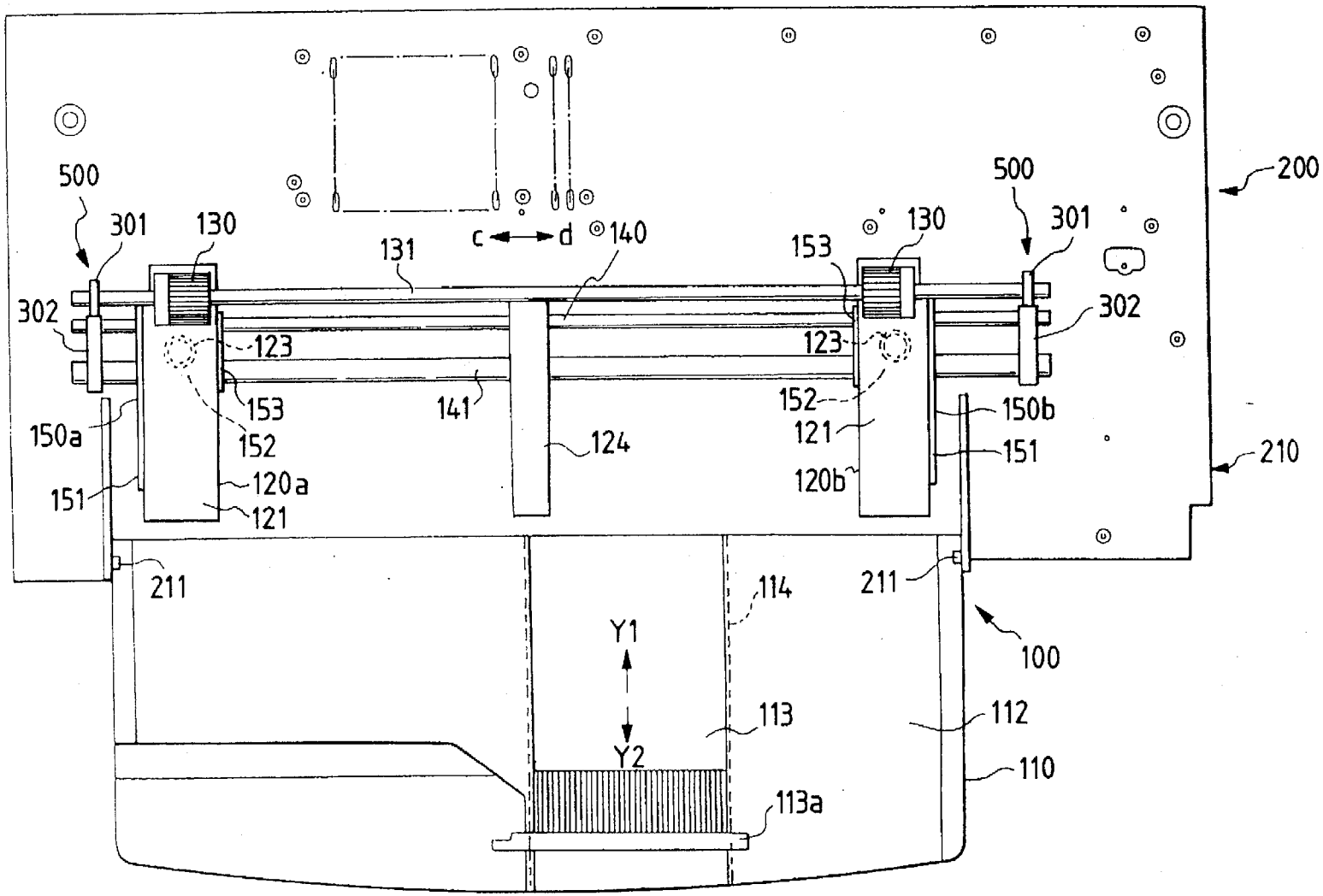
FIG. 2 is a top plan view of the sheet feeder assembly depicted in FIG. 1.

Reference is first made to FIGS. 1 and 2 which depicts a sheet feeder assembly, generally indicated at 100, constructed in accordance with the present invention. Also depicted is a main body of a printer, generally indicated at 200, which includes a printer case 210, constructed in accordance with the present invention. Printer 200 can be an ink jet printer, by way of example. However, the invention is applicable to any printing device requiring individual paper sheet feeding.

Sheet feeder assembly 100, mounted on case 210, may include a sheet support, generally indicated at 110, hoppers 120*a*, 120*b* and a sheet feed roller 130. Sheet support 110 includes a top surface 112 for supporting the bottom surface Pb of a sheet of paper P mounted on sheet support 110. A guide groove 114 is provided on a sheet support 110 on which a retaining plate 113 having a rear mounting paper retaining bar 113*a* is slidably mounted. In this way, retaining plate 113 can slide along top surface 112 of sheet support 110 in the directions indicated by arrows Y1, Y2 (FIG. 2). Retaining plate 113 contacts and supports a rear edge Pd of sheet P so that sheet P cannot slide any further backward than permitted by retaining plate 113. A lock mechanism may be provided to prevent retaining plate 113 from inadvertently or undesirably sliding along guide groove 114 once retaining plate 113 is placed in its desired position as discussed below. The sliding resistance of retaining plate 113 is preferably set so retaining plate 113 cannot be displaced by an extending force acting on sheet P when sheet feeder assembly 100 is operated as discussed below.

Figures 3, 4, 5:
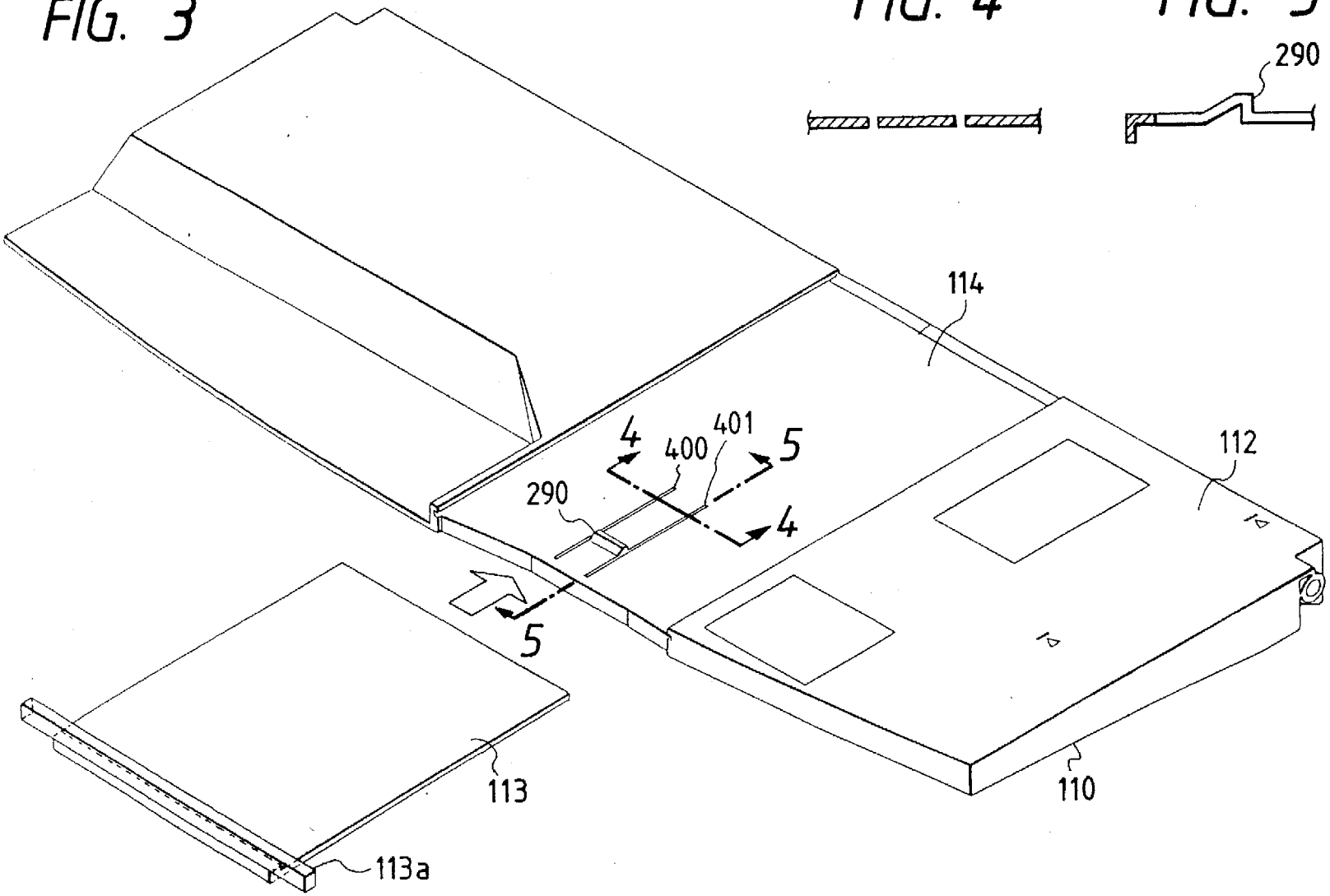
FIG. 3 is an exploded view showing the sheet support.
FIG. 4 is a cross-sectional view taken along lines 4—4 of FIG. 3.
FIG. 5 is a cross-sectional view taken along lines 5—5 of FIG. 3.

As shown in FIGS. 3 to 5, sheet support 110 includes a projecting portion 290 between slits 400, 401. The area between slits 400, 401 can deform elastically and have a function of a spring offering force to urge projecting portion 290 against the bottom of retaining plate 113. Retaining plate 113 slides over projecting portion 290. The pressing of a portion of sheet support 110 against projection portion 290 causes a friction brake to be produced.

Pins 211 are formed on printer case 210. Mounted on each side of sheet support 110 is a C-shaped latch 115 which receives a respective pin 211, so that sheet support 110 is rotatably and detachably mounted on printer case 210. A rotation restraint 111 is mounted on the bottom surface of sheet support 110 for restricting the rotation of sheet support 110 relative to printer case 210. With sheet support 110 mounted on pins 211, rotation restraint 111 of sheet support 110 can contact and rest against an edge of printer case 210 so as to restrict the rotation of sheet support 110 relative to printer case 210.

Main body 200 includes a frame 220, preferably made of metal. A support rod 141 is supported by a side frame (not shown) of main body 200.

As depicted in FIG. 1, a printing and feeding assembly 300 is mounted within printer main body 200 and includes a plurality of roller shafts and rollers for conveying a sheet of paper therethrough. Specifically, printing and feeding assembly 300 includes a sheet conveyance roller shaft 271 mounted in printer case 210 and a sheet conveyance roller 230 for conveying a sheet of paper to the printing section A rotatably mounted thereon. A roller shaft 276 is mounted in printer case 210, and a roller 277 for assisting the conveyance of the sheet of paper to the printing section is rotatably mounted thereon. A sheet guide plate 280 is also provided within printer body 200 for guiding the sheet of paper to rollers 230 and 277. The sheet of paper is fed between sheet conveyance roller 230 and roller 277. A print section A is provided within printer main body 200. A printing head 240, mounted in printer case 210, provides ink to the sheet of paper fed therethrough. Roller shafts 272 and 273 are mounted in printer case 210, and a pair of conveyance rollers 251,252 are respectively rotatably mounted thereon downstream of print section A for conveying the sheet of paper as the step of printing thereon is being completed. Lastly, a pair of sheet discharge roller shafts 274, 275 are mounted in printer case 210, and a pair of sheet discharge rollers 261,262 are rotatably mounted thereon for discharging the sheet of paper onto a sheet discharge tray (not shown) which may be arranged in an upper portion of the below described hoppers.

Figure 10:
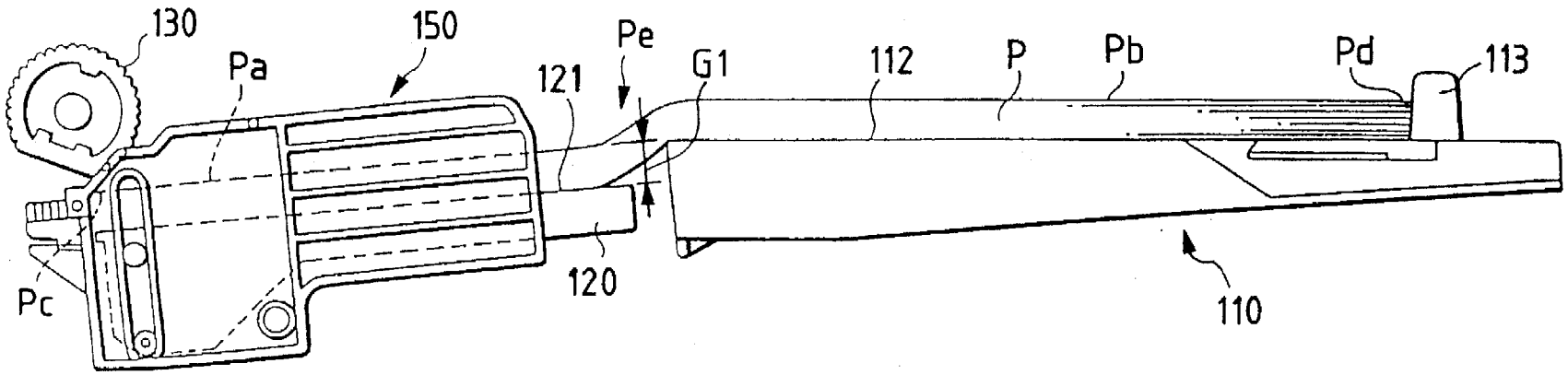
FIG. 10 is a sectional view of the sheet feeder assembly of FIG. 1 in a stand-by condition where the paper is not being fed into the printer, prior to the sheet feeding operation and having only one sheet of paper supported thereon.
Figure 11:
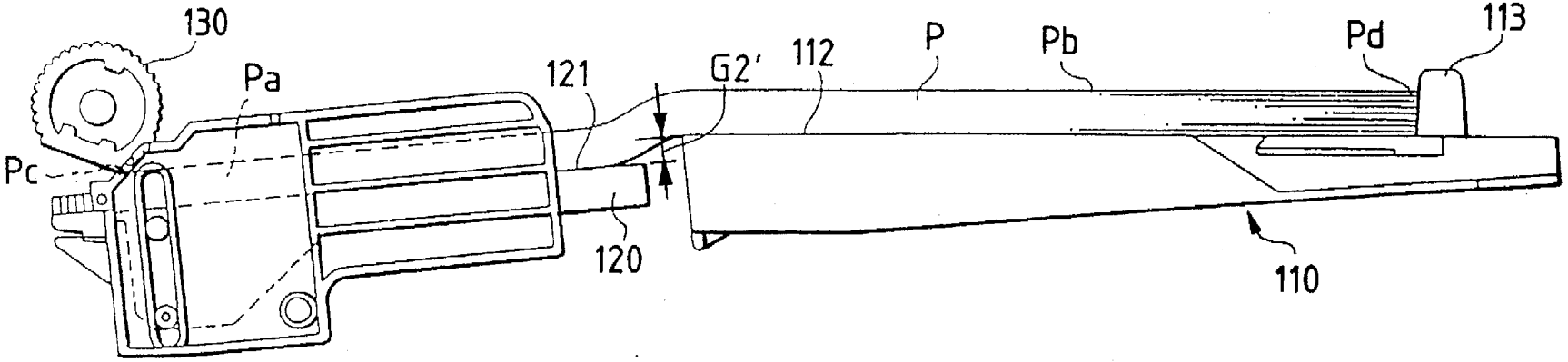
FIG. 11 is a sectional view of the sheet feeder assembly of FIG. 10 during a sheet feeding operation.

A hopper support rod 140 is supported on a support member (not shown) of printer 200 so that hopper support rod 140 can be movable between at least two positions in a vertical direction as depicted in FIGS. 10 and 11, by way of example. Sheet feed assembly 100 also includes two hoppers 120*a* and 120*b* which are provided within printer case 210. Each hopper 120*a* and 120*b* includes an elongated aperture 156 through which hopper support rod 140 is slidably inserted. Hoppers 12*a*, 120*b* are slidably mounted along rod 140.

Reference will now be made to hopper 120*a* although it is to be understood that hopper 120*b* is a mirror construction of hopper 120*a* so that, for simplicity of description, like reference numerals used to describe features and structures associated with hopper 120*a* will be used to describe features and structures used in connection with hopper 120*b*. Hopper 120*a* includes a top surface 121 for supporting a portion of the sheet of paper as it rests thereon or passes thereover. Hopper 120*a* includes an edge guide assembly, generally indicated at 150*a*. Edge guide assembly 150*a* includes an outer plate 151 for guiding the outer side edge of paper P, a bottom plate 152 which may be integrally formed with and laterally depending from outer plate 151, an inner plate 153 which may vertically extend from bottom plate 152 and a front plate 154 integrally formed and vertically extending from bottom plate 152. A beak-shaped support portion 155 is mounted on a front surface of front plate 154 and is slidably supported by frame 220. Outer plate 151 and inner plate 153 are slidably mounted on and supported by support rod 141. The inner surfaces of outer plate 151 and inner plate 153 may lightly engage the sides of hopper 120*a*. Edge guide assembly 150*a* and hopper 120*a* can slide together in together in the transverse direction (arrows c, d) as illustrated in FIG. 2. Moreover, a sheet feed roller holder, as known in the art, can engage edge guide assembly 150*a* so that sheet feed roller 130 can slide together with edge guide 150.

Elongated aperture 156 is formed on outer plate 151 of edge guide assembly 150*a* and 150*b*. As stated above, support rod 140 is inserted into elongated aperture 156 to permit support rod 140 to slide in the vertical direction therein. A pin 122 extends outwardly from the sides of each hopper 120*a* and 120*b* and is disposed in elongated aperture 156 so that pin 122 can slide in the vertical direction therein. In this way, hopper 120*a* and 120*b* can slide in the vertical direction with respect to each respective edge guide assembly 150*a* and 150*b*.

As stated above, hopper 120*b* is similar to hopper 120*a* in that hopper 120*b* also includes a top surface 121 for supporting a portion of the sheet of paper as it rests thereon or passes thereover and an edge guide assembly 150*b* which is similar to edge guide assembly 150*a*. Edge guide assembly 150*b* also includes outer plate 151, bottom plate 152, inner plate 153 and front plate 154. A center support 124 is mounted on rod 140 and supports the center of paper sheet P.

Figure 6:
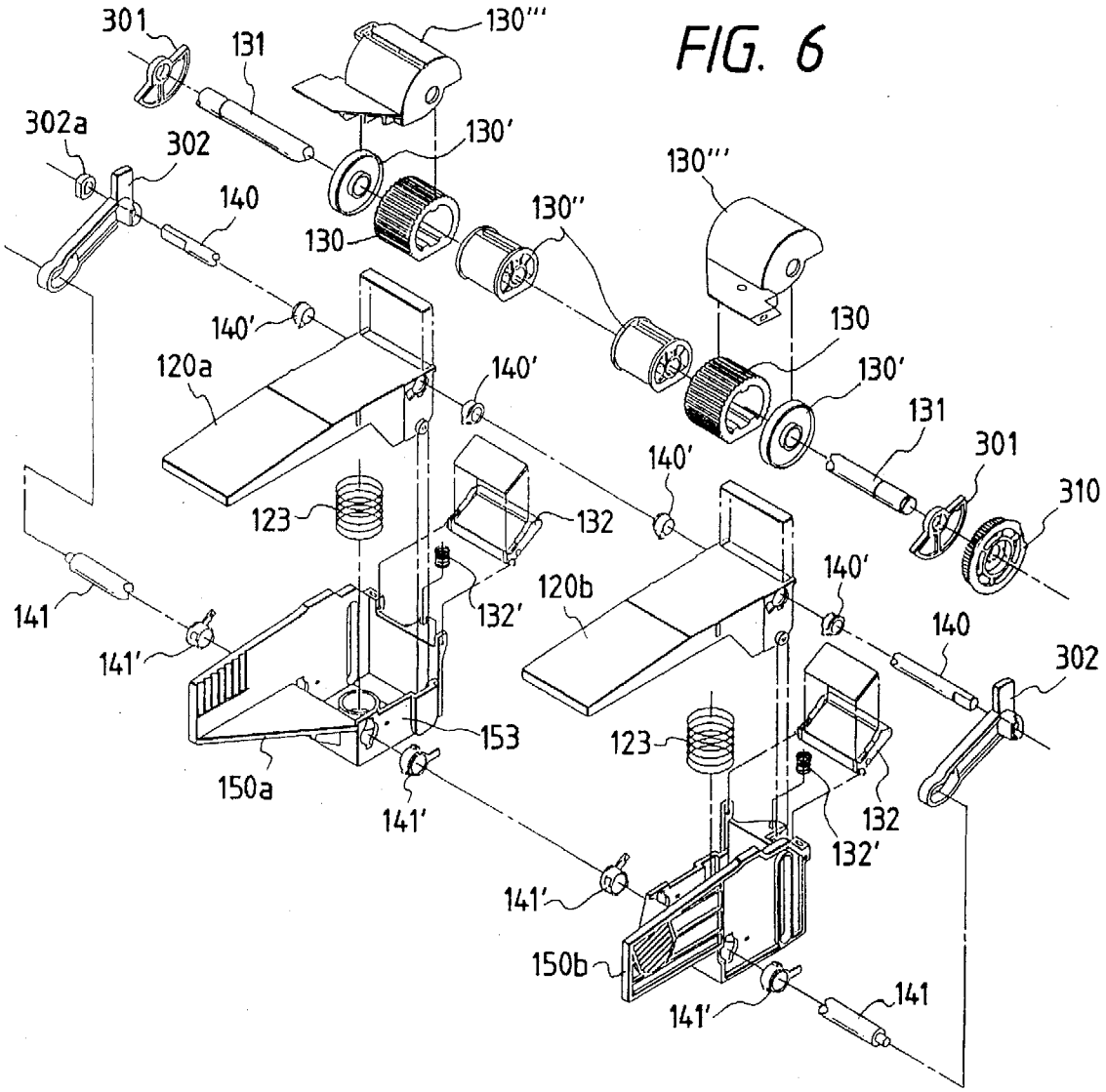
FIG. 6 is an exploded view showing the sheet hopper and the pushing mechanism.

As depicted in FIGS. 2 and 6, a respective hopper spring 123, which is preferably a compression spring, is positioned between a lower surface of each hopper 120*a*, 120*b* and respective bottom plate 152 of edge guide assembly 150*a*, 150*b*. Each hopper 120*a* and 120*b* is urged upwardly by the respective hopper spring 123. A pushing mechanism 500 is provided at each end of support rod 140. The pushing mechanism, which, by way of example, may be a cam mechanism, permits hopper 120*a* and 120*b* to be urged downwardly and positioned as illustrated by the dotted lines of FIGS. 1 and in the comparative relative positions illustrated in FIGS. 10–13. As the pushing mechanism 500 acts upon hoppers 120*a* and 120*b*, there is a resistance against the spring force of each hopper spring 123.

A detailed description of pushing mechanism 500 will be described below.

During a sheet feeding operation, each hopper 120*a* and 120*b* is not urged downward by the pushing mechanism 500, but rather, is urged upward by each respective hopper spring 123 so that a leading edge Pc of the sheet of paper (FIG. 11) can be urged toward sheet feed roller 130. During a stand-by condition when a sheet of paper is not being fed into the printer, hoppers 120*a* and 120*b* are urged downward by the pushing mechanism so that each hopper 120*a* and 120*b* is positioned a distance from sheet feed roller 130 as illustrated by the dotted lines in FIG. 1. In this way, the sheet of paper does not contact sheet feed roller 130.

As depicted in FIGS. 10 and 11, during a stand-by condition when paper is not being fed into the printer, hoppers 120*a* and 120*b* are positioned so that a relative height differential, or gap G1, exists (shown in FIG. 10) between top surface 121 of hoppers 120*a*, 120*b* and top surface 112 of sheet support 110. During the sheet feeding operation, hopper springs 123 cause hoppers 120*a* and 120*b* to move upward so that a second relative height differential, or gap G2, exists between the top surface 121 of hoppers 120*a*, 120*b* and top surface 112 of sheet support 110. As can be seen by comparing the relative displacement of hoppers 120*a* and 120*b* in FIGS. 10 and 11, the magnitude of the differential G1 is larger than the magnitude of the height differential G2. If the magnitude of differential G2 is zero, there is an essential alignment of top surface 121 of each hopper 120*a* and 120*b* and top surface 112 of sheet support 110.

In the preferred embodiment, a sheet feed roller shaft 131 is rotatably mounted in printer main body 200. Sheet feed roller shaft 131 is preferably rotatably supported by the side frame of main body 200 via a bearing and driven by a drive mechanism (not shown) provided in main body 200 during the sheet feeding operation. Sheet feed roller 130 is mounted on shaft 131 and rotates therewith. In a preferred embodiment, sheet feed roller 130 is a D-type roller having the grooved surface thereof covered with a layer of rubber-like material. A separation pad 132 is provided at the front portion of edge guide assembly 150*a* and 150*b* and is urged towards sheet feed roller 130 by an urging spring 132'. The pushing mechanism of each hopper 120*a* and 120*b* is mechanically coupled with the mechanism for driving sheet feed roller 130.

Reference is now made to FIG. 6 which depicts an exploded view of the sheet hoppers 120*a* and 120*b* and pushing mechanism 500. A cam 301 is provided at both sides of sheet feed roller shaft 131, respectively. Also rotatably mounted on sheet feed roller shaft 131 are a plurality of bushings 130' and a plurality of bushings 130". A cover 130'" is provided over each sheet feed roller 130 to maintain the integrity thereof. A cover plate 310 is also rotatably mounted on shaft 131. A lever 302 includes two apertures, one aperture to receive an end of hopper support rod 140 and another aperture to receive an end of support rod 141.

A plurality of bushings 140' are positioned in respective apertures located on the outer surfaces of each hopper 120*a* and 120*b*. Bushings 140' assist in facilitating the movement of hoppers 120*a* and 120*b*. A bushing 302*a* is also mounted on shaft 140 adjacent lever 302 to maintain the integrity of lever 302 on shaft 140. Similarly, a plurality of bushings 141' are mounted on shaft 140 and assist in maintaining the integrity of edge guide assemblies 150*a* and 150*b*. A spring 132' is provided on each guide assembly 150*a* and 150*b* for assisting in pressing against each respective separation pad 132 thereby causing separation pad 132 to move upwardly.

The inner plate 153 corresponds to an inner side wall of each respective edge guide assembly 150*a*, 150*b*. The inner plate 153 enhances the rigidity of edge guide assembly 150*a*, since when the edge guide assembly 150 slides laterally, the edge guide assembly 150*a* is supported by the inner plate 153 and the outer plate 151 so as to avoid a deformation thereof. Inner plate 153 also serves as a guide for hopper 120*a* when hopper 120*a* is operated.

Figure 7:
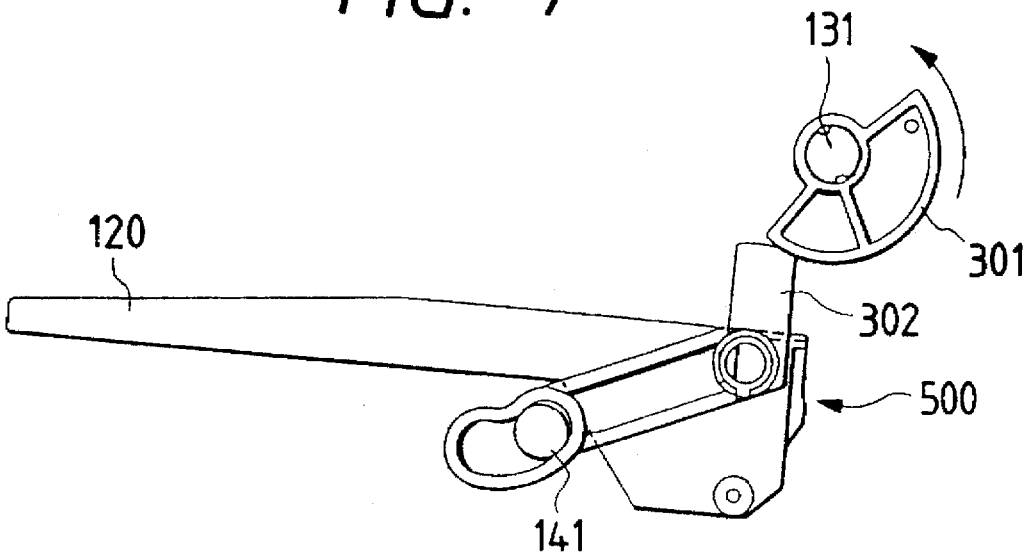
FIGS. 7 and 8 are enlarged views of the pushing mechanism.
Figure 8:
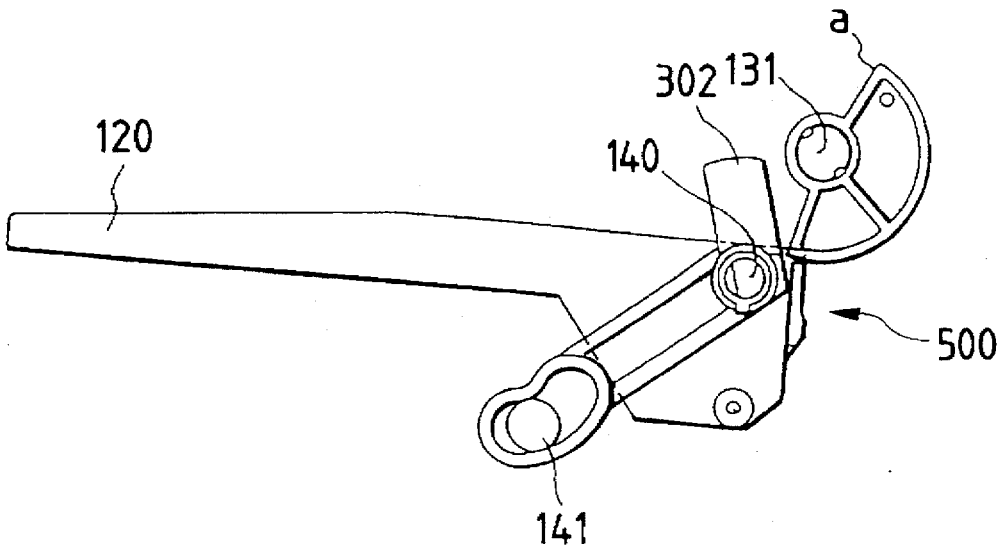
Figure 9:
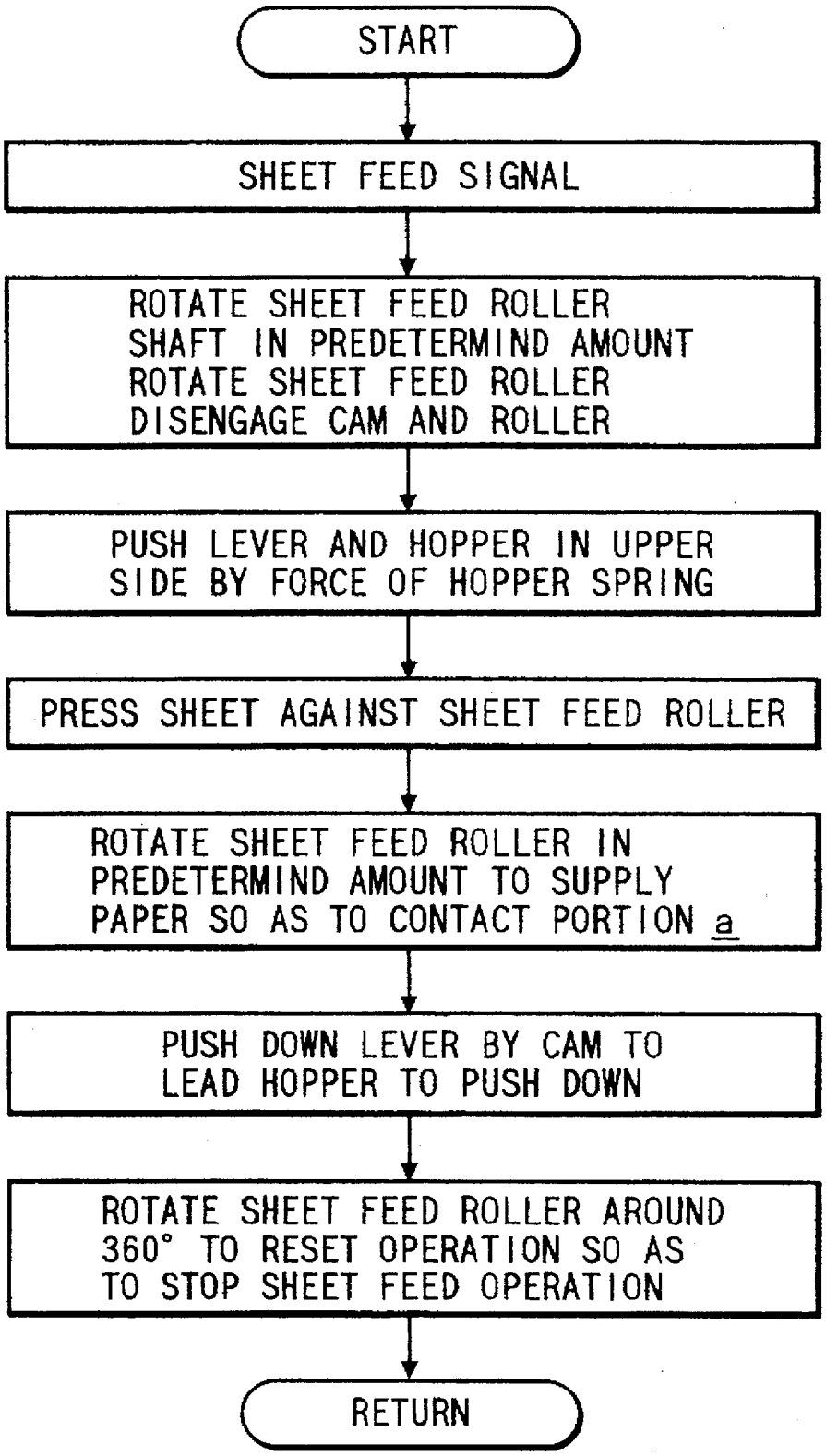
FIG. 9 is a flow chart of the sheet feeding operation.

As shown in the flowchart of FIG. 9, a sheet feed operation includes the steps of: issuing a sheet feed signal (step 1). At this time, the sheet feed roller shaft 131 rotates in a counterclockwise direction (as shown in FIG. 7) a predetermined amount causing sheet feed roller 130 to rotate therewith and cam 301 to rotate therewith. The rotation of sheet feed roller shaft 131 causes the disengagement of cam 301 and the lever 302 as shown by comparing the state of cam 301 and lever 302 depicted in FIG. 7 and FIG. 8 (step 2). The lever 302 is pushed upwardly causing shaft 140 and hopper 120*a* to move upwardly by a force of the hopper spring 123 (step 3). The front edge, of the sheet of paper is pressed and contacts against sheet feed roller 130 (step 4). The sheet feed roller shaft 131 further rotates in a counterclockwise direction a predetermined amount to obtain a sheet supplement and so as to bring a portion of the cam 301 back into contact with the lever 302 (step 5). The cam 301 depresses the lever 302 downward to push the hopper 120*a* (step 6). The sheet feed roller rotates to reset the operation and end the sheet feed operation. Although the aforementioned operation is described with respect to hopper 120*a*, the same operation applies to hopper 120*b*.

A sheet of paper is set in the above sheet feeder 100 as follows. As illustrated in FIG. 10, in the stand-by condition, a front portion Pa of the sheet of paper P is set on hoppers 120*a* and 120*b* on the front side of the printer. Since the sheet of paper is set on the front of the printer, the sheet setting operation can be easily preformed.

After the sheet of paper has been set in the hopper, retaining plate 113 may be slidably displaced in the direction indicated by arrow Y1 (in FIG. 2) until retaining plate 113 contacts the rear edge Pd of sheet of paper P. The leading end Pc of the sheet of paper is aligned by engagement with front plate 154 of edge guide 150.

On the other hand, once the retaining plate 113 is set, the retaining plate 113 does not move except when the sheet is supplied or the sheet having a size which is different from the previous sheet size is changed.

Thereafter, and as shown in FIG. 2, the outer plate 151 of edge guide assembly 150 of hopper 120*a* is slidably displaced so that outer plate 151 of each hopper 120*a* and 120*b* contacts the side edges of the sheet of paper. By sliding outer plate 151 corresponding to hopper 120*a*, the outer plate 151 associated with hopper 120*b* is also slidably displaced for alignment with the side edges of the sheet of paper. In addition, outer plate 151 associated with hopper 120*b* can be slidably displaced so as to slidably displace outer plate 151 associated with hopper 120*a*.

With the sheet of paper aligned as described above, the rear edge Pd of sheet P contacts retaining plate 113 of sheet support 110, the bottom surface Pb of sheet P is supported by top surface 112 of sheet support 110 and the front portion Pa of the sheet is supported by top surface 121 of hoppers 120*a* and 120*b*.

In accordance with the present invention, when a sheet of paper is mounted in the sheet feeding assembly, a rear edge of the sheet of paper P contacts the retaining plate 113 on the sheet support, the bottom portion of the sheet Pb is supported by the top surface of the sheet support 112, and the front portion of the sheet Pa is supported by the top surface 121 of the hoppers 120*a*, 120*b* and by the front plate 154 of the edge guide assemblies.

Hoppers 120*a*, 120*b* are disposed at a position distant and spaced apart from sheet feed roller 130 during the condition that paper is not being fed into the printer and the sheet feed roller 130 is not rotating, so that a relatively large first step is formed between the top surface 121 of the hoppers 120*a*, 120*b* and the top surface 112 of the sheet support 110. Accordingly, with the hoppers 120*a*, 120*b* spaced from sheet feed rollers 130, a sheet of paper being supported is greatly curved substantially along the first step.

Hoppers 120*a*, 120*b* are then urged upwardly towards the sheet feed rollers 130 so that a leading edge Pa of the sheet contacts the sheet feed roller. During the process of sheet feeding and as hoppers 120*a*, 120*b* are urged upwardly towards sheet feed rollers 130, a second and smaller step is formed between the top surface 121 of hoppers 120*a*, 120*b* and the top surface 112 of sheet support 110. Accordingly, the length of the curved portion of the sheet of paper is reduced. By reducing the length of the curved portion of the sheet of paper P, a compressive force acts on the paper due to the compression of the sheet of paper P between sheet feed rollers 130 and retaining plate 113. Due to the reduction of the length of the curved portion of the sheet of paper, an extending force F1 is generated on the sheet of paper itself, so that the sheet of paper is pushed toward the sheet feed roller.

By utilizing the above construction which includes at least one hopper and retaining plate as disclosed, an accurate and reliable sheet feeding operation is achieved even if the paper is supported in a horizontal condition because the sheet of paper can be urged toward the sheet feed roller by the extending force acting on the sheet of paper.

Furthermore, an accurate and reliable sheet feeding operation is achieved even if the sheet support is supporting a plurality of sheets of paper. As stated above, the hoppers are spaced apart from the sheet feed roller while in a stand-by mode and during which the sheet feed roller is not rotating, so that a relatively large step is formed between the top surface of the hoppers and the top surface of the sheet support. Accordingly, the sheets of paper supported thereon are greatly curved substantially along this large step.

During the sheet feeding operation, the hoppers are urged forward thereby eliminating the aforementioned large step, causing the paper to extend, eliminating the curved portion of the sheet of paper caused by the step portion described above and causing the leading edge of the paper to contact the sheet feed roller. By eliminating this curved portion, a compressive force acts on the sheet of paper by compression of the paper between the sheet feed roller and the retaining plate when the leading edge of the sheet of paper contacts the sheet feed roller and the trailing edge of the paper contacts the retaining plate. By utilizing a retaining plate that can be secured in position, any backward movement of the sheet of paper can be prevented. Due to the elimination of the curved portion of the sheet of paper, an extending force acting on the sheet of paper causes the sheet of paper to be accurately and releasably fed into the printer.

Accordingly, even if a plurality of sheets are loaded onto the sheet support, the present invention cannot only accommodate the plurality of sheets, but in addition, can accurately and reliably feed each sheet into the printer even when the plurality of sheets are horizontally supported.

Reference will now be made to FIGS. 10 and 11 for a more detailed description of the operation of the sheet feeder constructed in accordance with the present invention. The example provided illustrates only one sheet of paper P, such as the last sheet of paper, being placed in and supported by sheet feeder assembly 100. However, it is to be understood that the following description is applicable if more than one sheet of paper has been placed in sheet feeder assembly 100.

In the stand-by condition in which sheet feed roller 130 is not rotating (FIG. 10), each hopper 120*a* and 120*b* is spaced apart from sheet feed roller 130 and a relative height differential G1 exists between top surface 121 of each hopper 120*a* and 120*b* and top surface 112 of sheet support 110. Accordingly, the sheet will bend along the length of the sheet of paper. The bent portion of the sheet of paper is denoted Pe.

During the sheet feeding operation when sheet feed roller 130 is rotating (FIG. 11), each hopper 120*a* and 120*b* is urged in a direction so that the leading edge Pc of sheet of paper P can contact with sheet feed roller 130. Therefore, differential G2, which is still smaller in magnitude than differential G1, is formed between top surface 121 of hoppers 120*a*, 120*b* and the top surface 112 of sheet support 110. Accordingly, the length of the curved portion Pe of the sheet of paper caused by the height differentials described above can be reduced to accommodate the shortened differential. Accordingly, as the magnitude of height differential G2 approaches zero (0), the curved portion Pe is gradually eliminated.

With height differential G2 removed and the trailing end Pd of sheet of paper P contacting retaining plate 113 of sheet support 110, the sheet of paper is urged towards sheet feed roller 130 by a force F1 applied to sheet of paper P. Specifically, a compressive force F1 is applied to sheet of paper P by the sheet feed roller 130 and retaining plate 113, because the leading edge P1 of the sheet of paper comes into contact with the sheet feed roller 130. In other words, due to the reduction or the elimination of the curved portion of the sheet of paper, an extending force (F1) is generated on the sheet of paper itself, so that the sheet of paper is pushed towards the sheet feed roller 130.

Accordingly, an accurate and reliable sheet feeding operation can be achieved using a sheet feeder assembly constructed in accordance with the present invention. In addition, this accurate and reliable sheet feeding operation can be achieved with the sheet feeder assembly and, sheets of paper mounted and supported horizontally. This reliable sheet feeding operation is achieved by the sheet of paper being urged towards sheet feed roller 130 by the extending and compression forces generated and acting upon the sheet of paper itself.

Furthermore, by utilizing two spaced apart sheet feed rollers 130, the leading edge Pc of the sheet of paper contacts each sheet feed roller 130 by the aforementioned extending force (F1) acting on the sheet itself. Accordingly, the leading edge of the sheet P can be accurately aligned with respect to each sheet feed roller 130, and, therefore, there is an increased reliability that the sheet of paper will be accurately fed into the printer's print section (not shown), i.e. not fed in a skewed condition so as to have the print upon the paper appear slanted.

Figure 12:
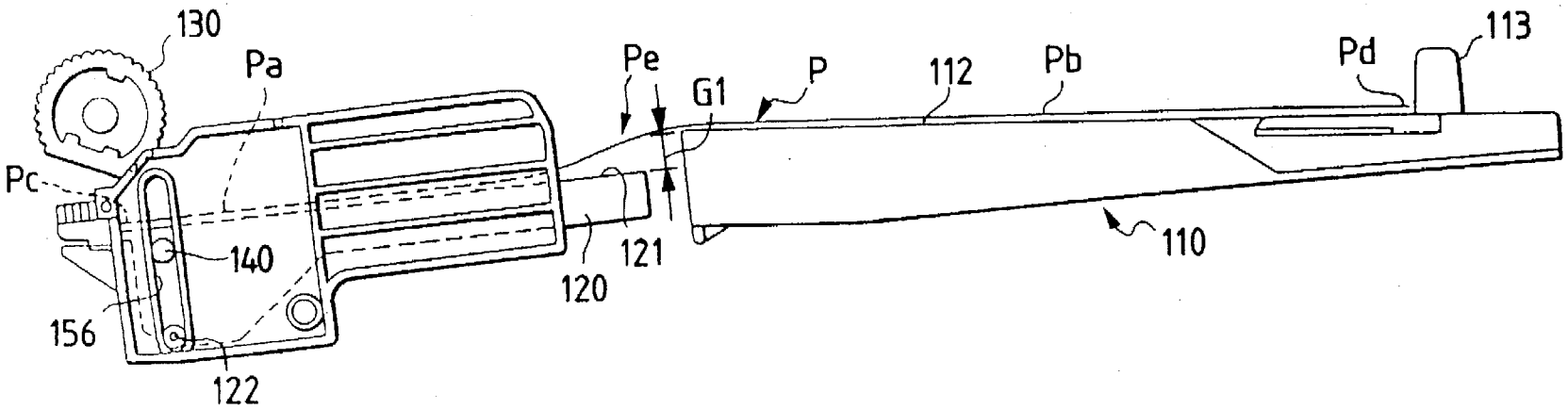
FIG. 12 is a sectional view of the sheet feeder assembly of FIG. 1 in a stand-by condition where the paper is not being fed into the printer, prior to the sheet feeding operation and having a plurality of paper supported thereon.
Figure 13:
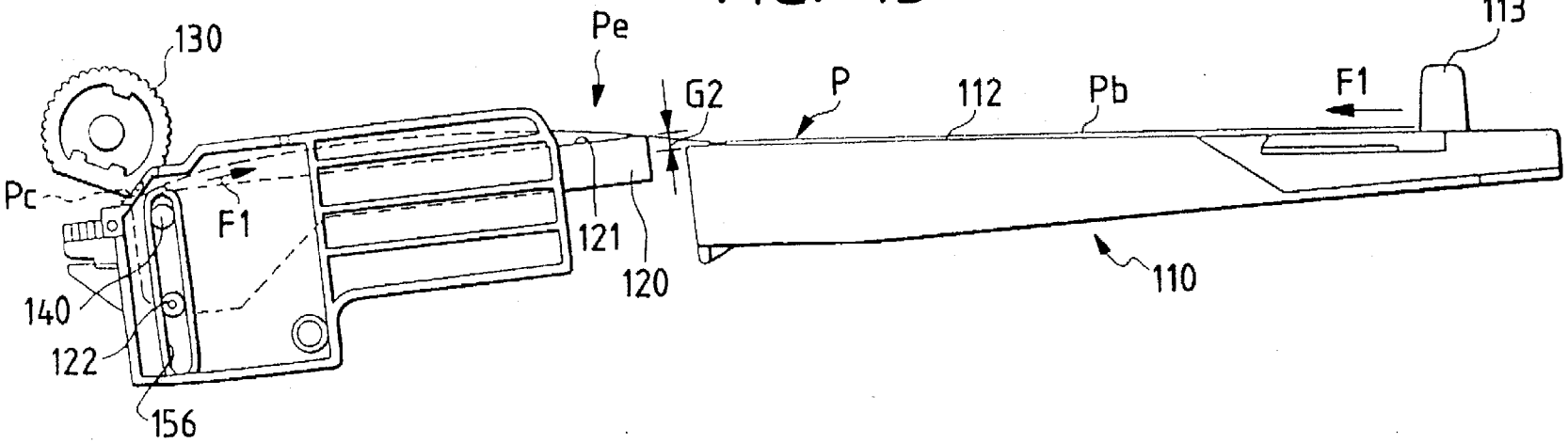
FIG. 13 is a sectional view of the sheet feeder assembly of FIG. 12 during a sheet feeding operation.
Figure 14:
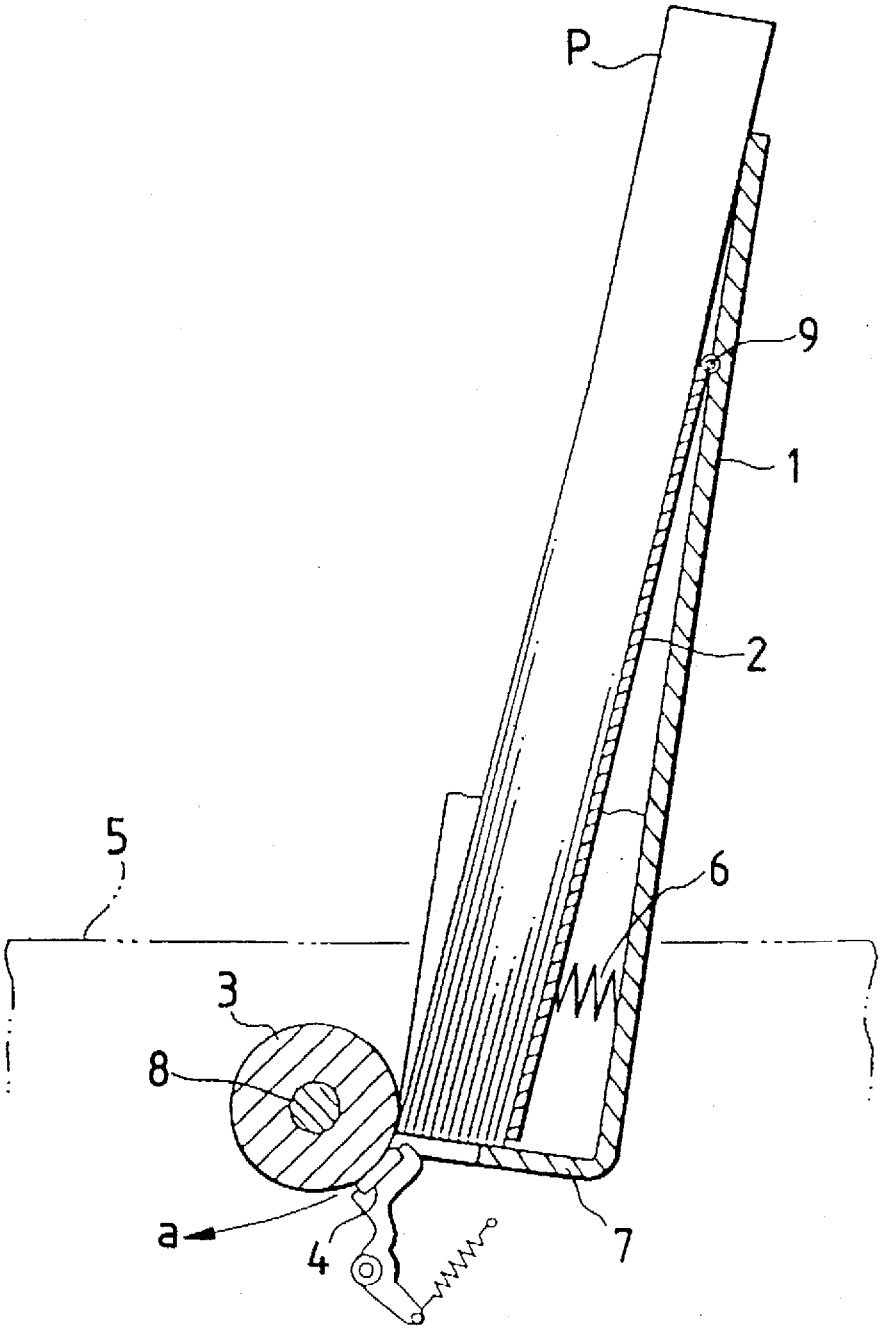
FIG. 14 PRIOR ART
FIG. 14 is a sectional view of a sheet feeder assembly constructed in accordance with the prior art.

Reference will now be made to FIGS. 12 and 13 which depict the operation of the sheet feeder assembly constructed in accordance with the present invention in which a plurality of sheets are mounted and supported in a horizontal position. As depicted in FIG. 13, when a plurality of sheets are mounted and supported on sheet support 110, the plurality of sheets of paper are also aligned so that the rear edges Pd of the paper P contact retaining plate 113 of sheet support 110, the bottom surface Pb of the sheets P are also supported by top surface 112 of sheet support 110 and the front portions Pa of the sheet are supported by top surface 121 of hoppers 120*a* and 120*b*, and against front plate 154 of each guide assembly 150*a*, 150*b*. As can be seen in FIG. 12, while the magnitude of the height differential G1 remains the same as the height differential G1 depicted in FIG. 10, the corresponding height differential G2' depicted in FIG. 13 is larger than the differential G2 measured and depicted in FIG. 11 by the thickness of the sheets. However, gap G2' is still smaller than the first gap G1.

In this connection, the uppermost sheet of paper contacts sheet feed roller 130 and is separated from the other sheets of paper by separation pad 132 as discussed above. That is, during the sheet feeding operation when sheet feed roller 130 is rotating (FIG. 13), each hopper 120*a* and 120*b* is urged in a direction so that the leading edge P1 of the topmost sheet of paper can contact with sheet feed roller 130. Therefore, differential G2', which is smaller in magnitude than differential G1, is formed between top surface 121 of hoppers 120*a*, 120*b* and the top surface 112 of sheet support 110. Accordingly, the length of the curved portion Pe of the sheet of paper caused by the height differentials described above is reduced. Accordingly, as the magnitude of height differential G2' approaches zero (0), the curved portion Pe is gradually eliminated.

With height differential G2' removed and the trailing end Pd of sheet of paper P contacting retaining plate 113 of sheet support 110, the topmost sheet of paper is urged towards sheet feed roller 130 by a force F1' applied to the topmost sheet of paper. Specifically, a compressive force F1' is applied to the topmost sheet of paper P by sheet feed roller 130 and retaining plate 113 because the leading edge PI of the topmost sheet of paper contacts sheet feed roller 130. In other words, due to the reduction or the elimination of the curved portion of the topmost sheet of paper, an extending; force F1' is generated on the topmost sheet of paper so that the top sheet of paper is pushed towards the sheet feed roller 130.

Thereafter, the rotation of sheet feed roller 130 in the clockwise direction causes the fed sheet of paper through printer body 200 in the direction indicated by arrow b depicted in FIG. 1 and through the print section as described above.

By providing a sheet feeding assembly that includes a retaining plate as disclosed, an improved sheet feeding assembly that permits the sheet support tray to be mounted horizontally is provided. By providing a sheet feeding assembly that includes at least one hopper movable between at least two positions, a sheet of paper can be fed into a printer during a sheet feeding operation by the forces acting on the paper by the interaction of the retaining plate and the sheet feed roller without requiring the sheet support to be vertically positioned so as to utilize the weight of the paper itself to be urged towards the sheet feed roller. By using the invention disclosed herein, a shorter space is required for the printer which is beneficial if conservation of space is a priority. Also, by utilizing two sheet feed rollers, an accurate and reliable sheet feeding operation is achieved by the elimination of the possibility of a skewed sheet of paper being fed towards the print section.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A sheet feeder assembly comprising:

a sheet support having a top surface for supporting at least a portion of at least one sheet of paper thereon;

a sheet feed roller spaced apart from the sheet support and positioned to feed a sheet of paper from the sheet support in a sheet feeding direction from a rear edge of a sheet of paper on the sheet support towards a leading edge of said sheet of paper;

a stop on said sheet support positioned to contact the rear edge of said sheet of paper and prevent said sheet of paper from moving in a direction substantially opposite to said sheet feeding direction while said sheet of paper is supported on said support surface;

at least one hopper located between the sheet support and the sheet feed roller, the hopper having a hopper support surface adapted to support at least a portion of said sheet of paper, said hopper support surface being displaceable between a first position spaced apart from said sheet feed roller so that a sheet of paper supported on said hopper does not contact said sheet feed roller and at least a second position where a front portion of said sheet of paper will contact said sheet feed roller; said hopper support surface and said sheet support top surface separated by a first offset distance, when said hopper support surface is at said first position and a second offset distance, when said hopper support surface is at said second position, the roller, hopper and sheet support constructed and arranged such that the leading edge of a sheet of paper with its rear edge against the stop is closer, in the paper path from the stop, to the roller, when the hopper support surface is in the second position than when it is in the first position, said first offset distance being greater than said second offset distance;

whereby a leading edge of said sheet of paper is urged in the sheet feeding direction when the hopper support surface is moved from said first position to said second position.

2. The sheet feeder assembly as claimed in claim 1, wherein said second offset distance is substantially equal to zero.

3. The sheet feeder assembly as claimed in claim 1, wherein said hopper support surface is positioned above said sheet support surface when said hopper is at said second position.

4. The sheet feeder assembly as claimed in claim 1, wherein said sheet feed roller, said hopper and said sheet support are constructed and arranged such that a bend is imparted in the sheet of paper when said hopper support surface is at said second position causing the sheet of paper to be urged towards said sheet feed roller.

5. The sheet feeder assembly as claimed in claim 1, wherein said sheet feed roller, said hopper and said sheet support are constructed and arranged such that when the hopper support is in the first position, the distance of the paper path from the stop to the roller is greater than the distance of the paper path from the stop to the roller when the hopper support is in the second position and the distance of said paper path when the hopper support is in the second position is greater than the length in the sheet feeding direction of said sheet of paper.

6. The sheet feeder assembly as claimed in claim 1, wherein said hopper includes an aperture, a support rod slidably disposed therein and movable between a first position and at least a second position, and a pin member coupled to said hopper and moveable between a first position and a second position, said hopper support surface being supported on said support rod, said support rod and said pin adapted to permit said hopper surface to be displaceable between said first and at least said second position.

7. The sheet feeder assembly as claimed in claim 1, and including a spring assembly for urging said hopper to at least said second position and a pushing mechanism for urging said hopper to said first position.

8. The sheet feeder assembly as claimed in claim 7, wherein said pushing mechanism includes a cam spaced apart from said sheet feed roller and a lever operatively coupleable to said cam, said cam adapted to engage and disengage said lever thereby permitting said hopper to be displaced from said first position to at least said second position.

9. The sheet feeder assembly as claimed in claim 1, wherein said stop is slidably mounted on said sheet support.

10. The sheet feeder as claimed in claim 1, further comprising at least a second hopper spaced apart from and in the same plane as the first hopper.

11. A printer comprising:

a printer case and a print section therein; and a sheet feeder assembly including:

a sheet support having a top surface for supporting at least a portion of at least one sheet of paper thereon a sheet feed roller spaced apart from the sheet support and positioned to feed a sheet of paper from the sheet support in a sheet feeding direction from a rear edge of a sheet of paper towards a front edge of said sheet of paper;

a stop on said sheet support positioned to contact the rear edge of said sheet of paper and prevent said sheet of paper from moving in a direction substantially opposite to said sheet feeding direction while said sheet of paper is supported on said support surface;

at least one hopper located between the sheet support and the sheet feed roller, the hopper having a hopper support surface adapted to support at least a portion of said sheet of paper, said hopper support surface being displaceable between a first position spaced apart from said sheet feed roller so that said sheet of paper supported on said hopper does not contact said sheet feed roller and at least a second position where a front portion of said sheet of paper can contact said sheet feed roller; said hopper support surface and said sheet support top surface separated by a first offset distance, when said hopper support surface is at said first position and a second offset distance, when said hopper support surface is at said second position, the roller, hopper and sheet support constructed and arranged such that the leading edge of a sheet of paper with its rear edge against the stop is closer, in the sheet feeding direction, to the roller, when the hopper support surface is in the second position than when it is in the first position, said first offset distance being greater than said second offset distance;

whereby a leading edge of said sheet of paper is urged in the sheet feeding direction when the hopper support surface is moved from said first position to said second position.

12. The printer as claimed in claim 11, wherein said second offset distance is substantially equal to zero.

13. The printer as claimed in claim 11, wherein said hopper support surface is positioned above said sheet support surface when said hopper is at said second position.

14. The printer as claimed in claim 11, wherein said sheet feed roller, said hopper and said sheet support are constructed and arranged such that a bend is imparted in said sheet of paper when said hopper support surface is at said second position causing said sheet of paper to be urged towards said sheet feed roller.

15. The printer as claimed in claim 11, wherein the distance of the paper path from the stop to the roller, is greater in the first position than in the second position, and when in the second position, is shorter than the length of said sheet of paper in the paper feeding direction.

16. The printer as claimed in claim 11, wherein said hopper includes an aperture, a support rod slidably disposed therein and movable between a first position and at least a second position, and a pin member coupled to said hopper and moveable between a first position and a second position, said hopper support surface being supported on said support rod, said support rod and said pin adapted to permit said hopper surface to be displaceable between said first and at least said second position.

17. The printer as claimed in claim 11, and including a spring assembly for urging said hopper to at least said second position and a pushing mechanism for urging said hopper to said first position.

18. The sheet feeder as claimed in claim 11, further comprising at least a second hopper spaced apart from and in the same plane as the first hopper.

19. A method of feeding a sheet of paper into a printer, said printer comprising a printer case, a sheet feeder assembly operatively coupled to said paper in a sheet feeding direction tangential to the bottom circumference of said sheet feed roller, a sheet support spaced apart from said sheet feed roller for supporting at least one sheet of paper thereon, and a hopper positioned between the roller and the sheet support, said hopper adapted to support at least a portion of a sheet of paper, said hopper having a hopper support surface displaceable between a first position spaced apart from said sheet feed roller and the sheet support by a first offset distance from the sheet support and at least a second position at a second offset distance from the sheet support, the method comprising the steps of:

positioning said hopper in said first position;

placing at least one sheet of paper on the sheet support and the hopper support, said sheet of paper having a leading edge spaced apart from the roller;

urging the leading edge of the sheet of paper in the sheet feeding direction to at least the nip between said roller and said hopper by moving the hopper from the first position to the second position and preventing the sheet of paper from moving in a direction opposite to said sheet feeding direction;

thereby causing the leading edge of the sheet of paper to be urged towards said sheet feed roller to be contacted thereby to cause the sheet of paper to be fed into said printer case in said sheet feeding direction.

20. The method as claimed in claim 19, and including the step of positioning said sheet support substantially parallel to a surface on which said printer case is being supported.

21. A method of feeding a sheet of paper into a printer, said printer comprising a printer case, a sheet feeder assembly operatively coupled to said printer case, said sheet feeder assembly including a sheet feed roller for feeding a sheet of paper in a sheet feeding direction tangential to the bottom circumference of said sheet feed roller, a sheet support spaced apart from said sheet feed roller for supporting at least one sheet of paper thereon, a cam rotatably mounted on said sheet feed roller shaft, a lever operatively engageable with said cam, and a hopper positioned between the roller and the sheet support, said hopper adapted to support at least a portion of a sheet of paper, said hopper having a hopper support surface displaceable between a first position spaced apart from the sheet support by a first offset distance and at least a second position at a second offset distance from the sheet support, the method comprising the steps of:

receiving a sheet feed signal;

rotating said sheet feed roller shaft through a predetermined angle causing said cam to disengage said lever;

urging the leading edge of the sheet of paper in the sheet feeding direction to at least the nip between said roller and said hopper by moving the hopper from the first position to the second position and preventing the sheet of paper from moving in a direction opposite to said sheet feeding direction, thereby causing the leading edge of the sheet of paper to be urged towards said sheet feed roller and contacted thereby; and rotating said sheet feed roller shaft through a further predetermined angle so that the sheet of paper is fed into said printer case and said lever is operatively engaged with said cam, thereby moving said hopper from said second position to said first position.

22. A sheet feeder assembly comprising:

a sheet support having a top surface for supporting at least a portion of at least one sheet of paper having a leading edge and a rear edge;

a sheet feed roller for feeding a sheet of paper in a sheet feeding direction tangential to the bottom circumference of said sheet feed roller;

a stop on said sheet support positioned to contact the rear edge of a sheet of paper and prevent said sheet of paper from moving in a direction substantially opposite to said sheet feeding direction while said sheet of paper is supported on said support surface;

a hopper, displaceable between a first position and at least a second position, for supporting at least a portion of said sheet of paper; said hopper, said stop and said sheet feed roller constructed and arranged such that movement of said hopper from the first position to the second position causes the leading edge of the sheet of paper to be urged in the sheet feeding direction to at least the nip between said roller and said hopper.

* * * * *